US009029670B2

(12) United States Patent
Strandberg

(10) Patent No.: US 9,029,670 B2
(45) Date of Patent: May 12, 2015

(54) ERGONOMIC NECK FOR STRINGED INSTRUMENT

(71) Applicant: Ola Maans Erik Strandberg, Uppsala (SE)

(72) Inventor: Ola Maans Erik Strandberg, Uppsala (SE)

( * ) Notice: Subject to any disclaimer, the term of this patent is extended or adjusted under 35 U.S.C. 154(b) by 212 days.

(21) Appl. No.: 13/733,522

(22) Filed: Jan. 3, 2013

(65) Prior Publication Data

US 2013/0186254 A1 Jul. 25, 2013

(30) Foreign Application Priority Data

Jan. 3, 2012 (SE) ..... 1230001-8

(51) Int. Cl.
*G10D 3/00* (2006.01)
*G10D 3/06* (2006.01)

(52) U.S. Cl.
CPC ..... *G10D 3/06* (2013.01)

(58) Field of Classification Search
CPC ..... G10D 3/06
USPC ..... 84/293, 267; D17/20
See application file for complete search history.

(56) References Cited

U.S. PATENT DOCUMENTS

| | | | | | |
|---|---|---|---|---|---|
| 3,319,504 | A | * | 5/1967 | Appleton | 84/314 R |
| 4,534,260 | A | * | 8/1985 | Burrell | 84/293 |
| 4,852,450 | A | | 8/1989 | Novak | |
| 5,140,887 | A | * | 8/1992 | Chapman | 84/646 |
| 5,239,908 | A | * | 8/1993 | Attias | 84/267 |
| 5,852,249 | A | * | 12/1998 | Steinberg et al. | 84/293 |
| 6,034,308 | A | | 3/2000 | Little | |
| D630,676 | S | | 1/2011 | Toone | |
| D635,182 | S | * | 3/2011 | Toone | D17/20 |

* cited by examiner

*Primary Examiner* — Jianchun Qin
(74) *Attorney, Agent, or Firm* — San Diego IP Law Group LLP

(57) ABSTRACT

A neck construction for a stringed instrument such as a guitar has an asymmetric, preferably trapezoidal, profile of the neck. The asymmetry is opposite at the distal end, depicted in FIG. 9, and proximal end, depicted in FIG. 10. As the musician plays the instrument, the hand will move between the proximal and distal ends of the neck, using the thumb and palm as a support to press the fingers against the front portion of the neck. By changing the angles of the surfaces denoted as (15) and (19), and (16) and (20) from the proximal to the distal end, the musician's wrist is encouraged and guided to move in a comfortable and relaxed angle throughout the playing range of the instrument, while the musician's muscles and tendons are supported, thereby reducing the risk for the musician to develop repetitive strain injuries and allowing the musician to play better.

11 Claims, 6 Drawing Sheets

ERGONOMIC NECK FOR STRINGED INSTRUMENT

CROSS-REFERENCE TO RELATED APPLICATIONS

The present application claims priority under 35 U.S.C. §119 to Sweden Patent Application No. SE1230001-8, filed on Jan. 3, 2012, entitled "Ergonomic Neck for Stringed Instrument," the disclosure of which is incorporated by reference in its entirety.

BACKGROUND OF THE INVENTION

1. Field of Invention

The present invention is a novel cross-sectional profile of the neck of a stringed instrument such as a guitar or bass. The design of the neck profile increases the efficiency of the tendon system of the hands, wrists and arms, thereby reducing the risk for the musician to develop the repetitive strain injuries to which guitar and bass players are prone.

2. Description of Related Art

A guitar typically has two main components, a neck and a body. The musician squeezes the strings of the guitar against frets that are on the neck in order to change intonations of the strings. The design of the neck is therefore an important part of the guitar's performance and ergonomics.

The neck is sometimes manufactured as a separate part that is bolted on to the body portion, sometimes the neck is glued to the body, and sometimes, the neck is manufactured from a piece that is an integral part of the body. FIG. 1 shows a perspective view of a so called bolt-on neck. The cross section of a conventional guitar neck most commonly describes a semi-circle as depicted in FIG. 2. As a matter of preference, musicians choose a flatter or rounder, thinner or thicker profile.

When the musician plays the instrument, the thumb or palm of the hand presses against the rear portion (4) of the neck depicted in FIG. 2 while the fingers press the strings against the fingerboard (3). The semi-circular shape allows placement of the thumb at any place along the section. Pushing the thumb or palm against this semi-circular is inherently unstable and muscles in the thumb, palm, forearm and upper arm are all engaged. The hand constantly adjusts, attempting to maintain balance on this small contact area. The spacing between the strings of most stringed instruments increases from the distal end to the proximal end, in order to allow more room to pluck the strings near the proximal end. Because of this generally increasing spacing, the embodiments herein are shown with a wider cross section at the proximal end, but this should not limit the invention to neck shapes with different widths of the distal and proximal end.

A profile that supports the muscles of the hand better than the conventional shape is depicted in FIG. 3. This shape is depicted in prior art U.S. Design Pat. No. D630,676, and a variant as in FIG. 4 is depicted in U.S. Design Pat. No. D635,182. These neck profiles allow the musician to play more relaxed by providing a larger and more stable contact area for the thumb, and thereby preventing injury of the tendons in fingers and hands, and allowing the musician to play longer and faster.

An area which is not addressed in the previously discussed prior art is relieving tension of the muscles in the wrist. To change the intonation of the strings, the musician will press the strings against the fingerboard at varying locations along the length of the neck. Often, multiple strings are depressed at the same time in patterns to form chord voicings. Forming these chord voicings at different locations of the neck affects the angle of the wrist acutely, often requiring the musician to bend the wrist at a sharp angle when playing at the distal end 1 of the neck in FIG. 1 while having a more relaxed angle at the proximal end 2 of the neck in FIG. 1.

There is prior art for a solution that addresses providing a more relaxed angle of the wrist throughout the range of play in U.S. Pat. No. 6,034,308, which describes twisting the neck along its axis, providing a 5°-65° rotation of the distal end (5) in FIG. 5 compared to the point where the strings are anchored in the body, leaving the proximal end (6) parallel in relation to the body or at some angle. This solution, however, is a radical departure from common construction techniques, is complex to manufacture and does not allow many common maintenance operations using standard tools or knowledge.

Lastly in the prior art, U.S. Pat. No. 4,852,450 describes a way to position the frets, which provide fixed intonation positions on which the strings can be depressed, in a "fan" shape that provides sonic advantages. Such a fanned layout, however more subtle than what is described in the prior art, of the frets is depicted in FIG. 6. The result of fanning the layout of the frets is that each string has its own scale length. Depending on the size of the musician and the playing style, a difference in scale length between the longest and the shortest scale of no less than 12 mm and no more than 37 mm can affect the wrist angle of the musician in a positive way throughout the range of play.

SUMMARY OF THE INVENTION

The inventor of the present invention discovered a way to provide guidance for the hand and wrist when moving between the proximal and distal ends of a stringed instrument neck, encouraging a relaxed wrist position throughout the playing range, while maintaining standard construction techniques. According to certain embodiments of the invention, stress and fatigue of the fingers, palm, wrist and entire arm is reduced.

It is therefore an objective of the present invention to provide a stringed instrument neck profile that promotes relaxed playing, to reduce stress and strain of muscles and tendons in the fingers, palm, lower arm and upper arm.

It is a further objective of the invention to guide the musician's wrist in a relaxed position throughout the playing range from the proximal end of the neck to the distal end.

Another objective of the invention is to provide a neck construction for a musical instrument with ergonomic benefits that can be constructed and maintained using standard tools and common knowledge.

Further scope of applicability of the present invention will become apparent from a review of the detailed descriptions and accompanying drawings. It should be understood that the description and examples, while indicating preferred embodiments of the present invention, are not intended to limit the breadth of the invention since various changes and modifications within the spirit and scope of the invention will become apparent to those skilled in the art. In particular, all described embodiments describe a trapezoidal cross section, i.e. with exactly two parallel sides, but a quadrangular shape with no parallel sides is another possible embodiment. Additionally, the edges of the trapezoidal profiles in the drawings are shown sharp, but should be smoothed and rounded according to the personal preference of the musician, while maintaining the trapezoidal cross section.

BRIEF DESCRIPTION OF THE DRAWINGS

The present invention will become more fully understood from the detailed description given below, together with the accompanying drawings which are given by way of illustration only, and thus are not to be construed as limiting the scope of the present invention. In the drawings.

DETAILED DESCRIPTION OF EMBODIMENTS

Figure 1:
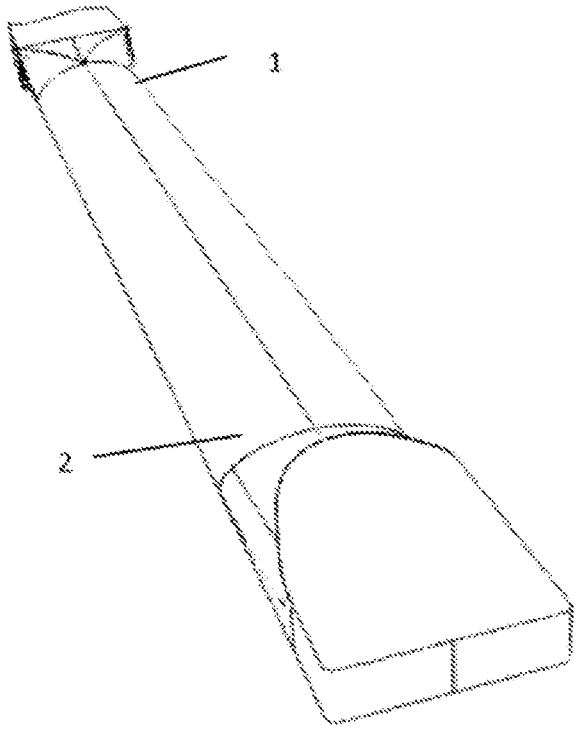
Fig. 1 (Prior Art)
FIG. 1 shows a perspective view of a conventional bolt-on guitar neck as an example of prior art.
Figure 6:
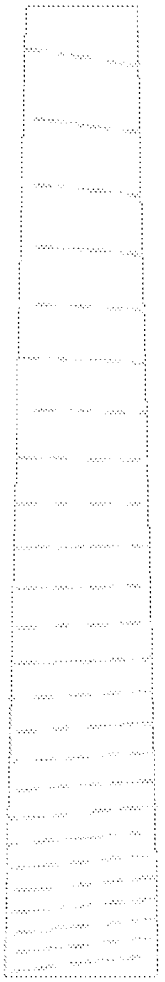
Fig. 6 (Prior Art)
FIG. 6 shows a layout of frets on a fingerboard as described in prior art U.S. Pat. No. 4,852,450, but with a more subtle fan than described in the preferred embodiments of that patent.
Figure 2:
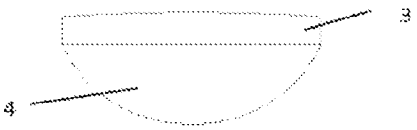
Fig. 2 (Prior Art)
FIG. 2 shows a cross section of a conventional neck for a stringed instrument.
Figure 3:
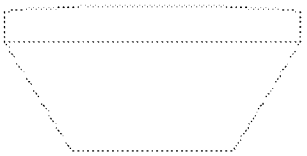
Fig. 3 (Prior Art)
FIG. 3 shows a trapezoidal cross section of a guitar neck as depicted in prior art U.S. Design Pat. No. D630,676.
Figure 4:
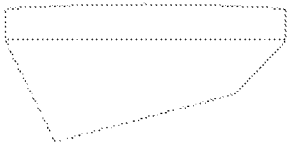
Fig. 4 (Prior Art)
FIG. 4 shows a cross section of a guitar neck as depicted in prior art U.S. Design Pat. No. D635,182.
Figure 5:
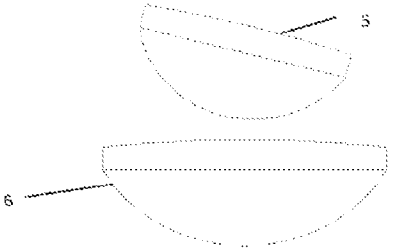
Fig. 5 (Prior Art)
FIG. 5 shows the interrelation of the distal and proximal end of an embodiment of prior art U.S. Pat. No. 6,034,308.
Figure 7:
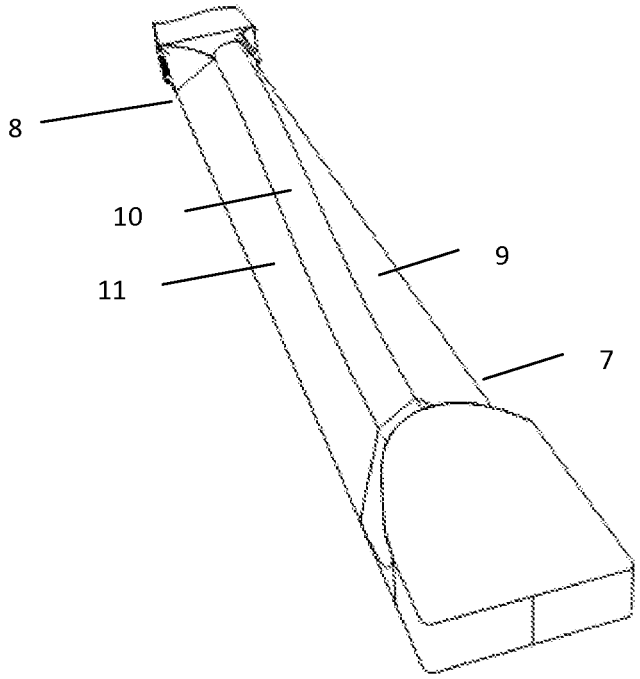
FIG. 7 shows a perspective view of a bolt-on embodiment of the present invention.

FIG. 7 shows an embodiment of the present invention in perspective. As a musician plays the instrument, the hand moves between the proximal end (7) and the distal end (8). A plurality of strings, anchored in place above the fingerboard, are pressed against the fingerboard using the fingers, while the thumb or palm of the hand is supported by the flat surfaces (9), (10), and (11). The curve of the surface (9) encourages the thumb to follow it and thereby straightening the wrist as the hand is moved towards the distal end (8). When playing certain chords, the asymmetric displacement of the surface (10) from being closer to the thumb at the distal end where the neck is narrow, to being closer to the palm at the proximal end where the neck is wider, the hand is further allowed to relax in a comfortable grip with full support for the thumb against surface (10).

Figure 8:
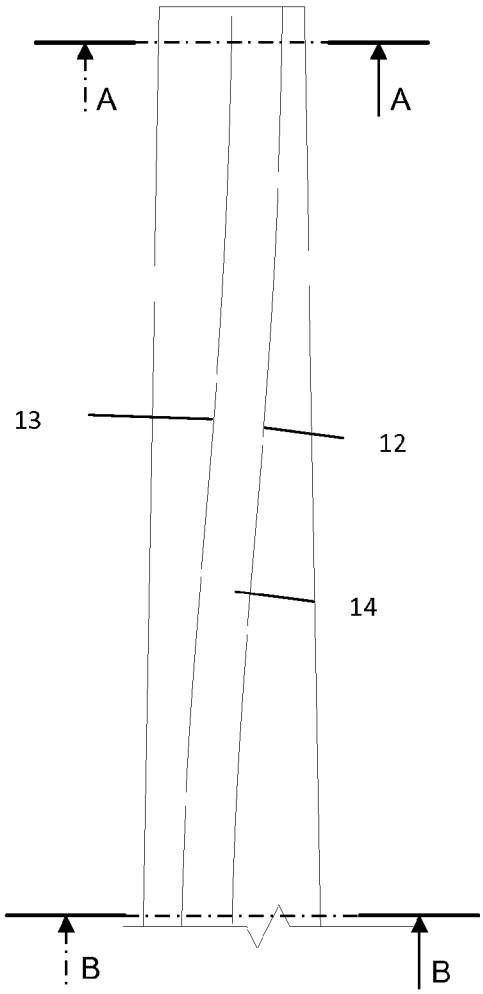
FIG. 8 shows how the flat surface that is parallel to the front portion of the neck describes a quarter of a sinus-like curve from the proximal to the distal end of the neck.

FIG. 8 shows a view from the rear of the portion of the neck that is subject for this patent, with the proximal end at the bottom and the distal end of the neck on the top. In this picture, a quarter sinus curve is formed by the edges (12) and (13) of the surface (14) that is parallel to the front portion (fingerboard) of the neck and that forms the thumb support. The designations A-A and B-B refer to figures FIG. 9 and FIG. 10 respectively.

Figure 9:
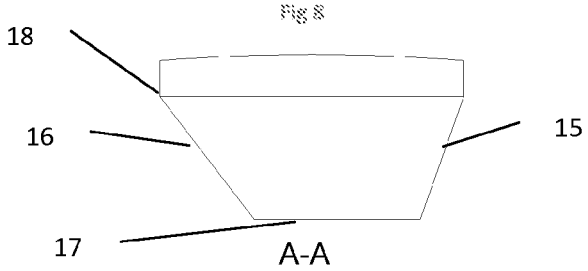
FIG. 9 shows the cross section of the distal end of an embodiment of the present invention.

FIG. 9 shows the distal end schematic cross sections of the points A-A as indicated in FIG. 8. It can be seen that the trapezoidal shape is shifted asymmetrically in the direction of the thumb of the (right-handed) musician, which will be supported by surfaces (15) and (17), while the sharper angle of where the surface (16) joins the fingerboard at point (18) gives the joint of the palm and index finger of the musician room to move comfortably. The angle of surface (15) and the fact that surface (17) is shifted asymmetrically from the center of the neck guides the wrist into a relaxed and straighter angle than on a conventional neck. For a left-handed musician, the asymmetry would be mirrored.

Figure 10:
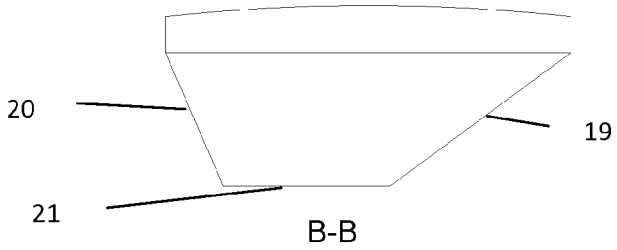
FIG. 10 shows the cross section of the proximal end of an embodiment of the present invention.

FIG. 10 shows the proximal end schematic cross section at the point B-B as indicated in FIG. 8. It can be seen that the trapezoidal shape is shifted asymmetrically towards the palm of the (right-handed) musician. The surface (20) supports the palm and joint between palm and index finger and allows for a correct and relaxed angle of the wrist when accessing the proximal end of the neck. Surfaces (19) and (21) provide support for the thumb in a way that makes it easier to reach around the neck and the musician experiences that the neck feels slimmer than a conventional neck. For a left-handed musician, the asymmetry would be mirrored.

Figure 11:
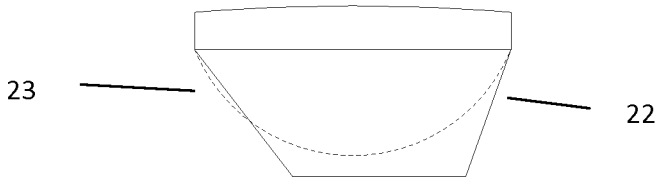
FIG. 11 shows a comparison between a conventional neck profile and an embodiment of the present invention.

FIG. 11 shows a comparison between the asymmetric trapezoidal cross section and a conventional cross section. It can be seen how the thumb would receive more support and guidance to straighten the wrist on surface (22) of the object of the invention while the palm of the hand and the joint of the palm and index finger are given room to move on surface (23).

Figure 12:
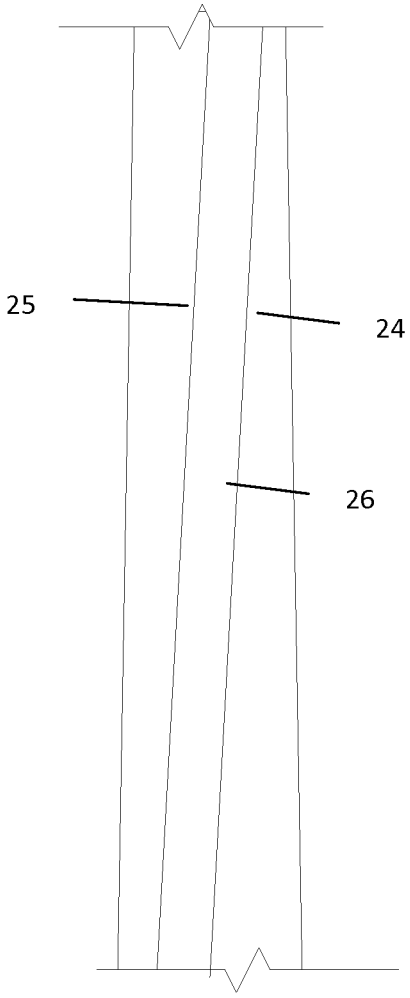
FIG. 12 shows how the flat surface that is parallel to the front portion of the neck describes a straight line from the proximal to the distal end of the neck.

FIG. 12 shows the rear view of a portion of an alternate embodiment of the invention, where the edges (24) and (25) of the surface (26) parallel to the front portion (fingerboard) of the necks forms straight lines from the proximal end to the distal end. The disposition of the edges (24) and (25) and the width of surface (26) will be a matter of personal preference.

Figure 13:
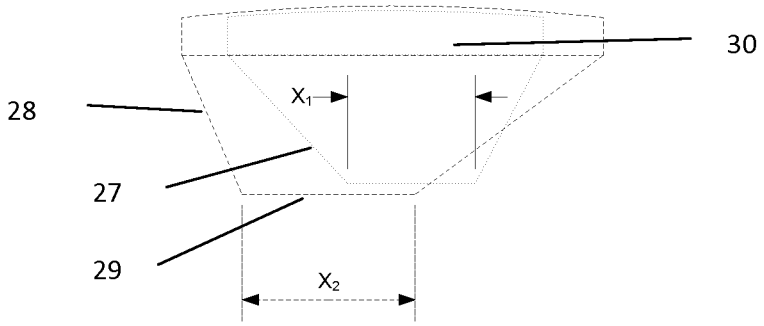
FIG. 13 shows a comparison of the cross sections of the distal end and the proximal end.

FIG. 13 shows a comparison of the cross sections of the distal end (27) and the proximal end (28). A preferred embodiment has the same widths $X_1$ and $X_2$ of the surface (29) parallel to the front portion of the neck (30). Musical instrument necks come in many different sizes depending on, for example, the number of strings or personal preference. In some instances, the width $X_1$ of the surface (29) may be reduced.

Figure 14:
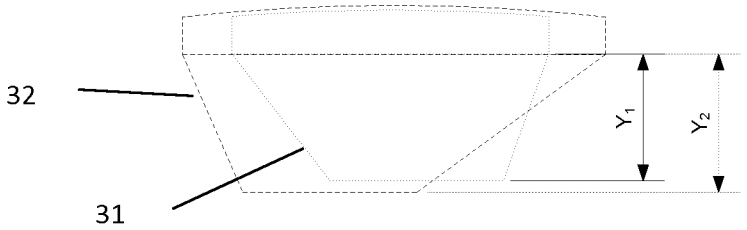
FIG. 14 shows a comparison of the cross sections of the distal end and the proximal end.

FIG. 14 shows a comparison of the cross sections of the distal end (31) and the proximal end (32). A preferred embodiment has the same heights $Y_1$ and $Y_2$ of the trapezoid. Musical instrument necks come in many different sizes depending on, for example, the number of strings or personal preference. In some instances, the height $Y_1$ of the trapezoid may be reduced.

I claim:

1. A neck portion for a stringed instrument, comprising:

a proximal end closer to the musician;

a distal end farther away from the musician;

a front facing portion, forming the area where the strings are pressed using the fingers in order to sound different notes; and a rear facing portion, forming the pinch support for the hand and thumb, said rear facing portion having an asymmetrical quadrangular, preferably trapezoidal, cross-section, the asymmetry being opposite on the proximal and the distal ends.

2. The neck portion of claim 1, wherein the asymmetry of the preferably trapezoidal cross-section on the distal end is shifted towards the player's thumb and the asymmetry of the preferably trapezoidal cross-section on the proximal end is shifted towards the player's palm, when the neck is gripped in a conventional pinch grip.

3. The neck portion of claim 2, wherein the edges of the surface of the rear portion parallel to the front portion of the neck describe a curve between the proximal end and the distal end.

4. The neck portion of claim 2, wherein the edges of the surface of the rear portion parallel to the front portion of the neck describe a portion of a sinus curve between the proximal end and the distal end.

5. The neck portion of claim 2, wherein the edges of the surface of the rear portion parallel to the front portion of the neck describe a straight line between the proximal end and the distal end.

6. The neck portion described in claim 2, wherein the surface of the rear portion parallel to the front portion of the neck has the same width between the proximal end and the distal end.

7. The neck portion described in claim 2, wherein the surface of the rear portion parallel to the front portion of the neck is wider at the proximal end than at the distal end.

8. The neck portion described in claim 2, wherein the height of the trapezoid in the trapezoidal cross-section is the same in the proximal end and the distal end.

9. The neck portion described in claim 2, wherein the height of the trapezoid in the trapezoidal cross-section is higher in the proximal end than in the distal end.

10. The neck portion described in claim 2, the front facing portion fitted with frets used as guides for the strings to sound tones accurately; said frets laid out in a fanned manner to support a scale of tones with a longer string near one end of the frets and the same scale of tones with a shorter string near the other end of the frets.

11. The neck portion described in claim 10, wherein the difference between the longest and the shortest string length used for the scale of tones is between 12 mm and 37 mm.

* * * * *